US009359094B2

(12) United States Patent
Vaughn

(10) Patent No.: US 9,359,094 B2
(45) Date of Patent: Jun. 7, 2016

(54) GRIPPING MECHANISM

(71) Applicant: L & P PROPERTY MANAGEMENT COMPANY, South Gate, CA (US)

(72) Inventor: Mark A. Vaughn, Wyandotte, OK (US)

(73) Assignee: L & P Property Management Company, South Gate, CA (US)

( * ) Notice: Subject to any disclaimer, the term of this patent is extended or adjusted under 35 U.S.C. 154(b) by 82 days.

(21) Appl. No.: 14/202,407

(22) Filed: Mar. 10, 2014

(65) Prior Publication Data

US 2015/0251788 A1 Sep. 10, 2015

(51) Int. Cl.
*B65B 13/26* (2006.01)
*B65B 13/02* (2006.01)
*B65B 13/18* (2006.01)

(52) U.S. Cl.
CPC ..... *B65B 13/185* (2013.01); *B65B 13/02* (2013.01); *B65B 13/26* (2013.01)

(58) Field of Classification Search
CPC ..... B65B 13/24; B65B 13/26; B65B 13/28; B65B 13/18; B65B 13/285; B65B 13/305; B65B 13/02; B65B 13/06
USPC ..... 100/29, 30, 32, 33 R; 140/93.6, 111, 140/115, 118
See application file for complete search history.

(56) References Cited

U.S. PATENT DOCUMENTS

| | | | | |
|---|---|---|---|---|
| 25,783 | A | | 10/1859 | White |
| 1,460,649 | A | | 7/1923 | Gerrard |
| 1,868,141 | A | | 7/1932 | Harvey |
| 1,939,746 | A | | 12/1933 | Whitman |
| 2,756,783 | A | | 7/1956 | Osuch |
| 2,853,885 | A | | 9/1958 | Seltzer |
| 2,859,687 | A | | 11/1958 | Hill |
| 2,907,356 | A | * | 10/1959 | Miille ..... B65B 13/285 140/93 R |
| 2,922,359 | A | | 1/1960 | Brouse et al. |

(Continued)

FOREIGN PATENT DOCUMENTS

| | | | |
|---|---|---|---|
| CN | 2050497 | U | 1/1990 |
| CN | 2451488 | Y | 10/2001 |

(Continued)

OTHER PUBLICATIONS

Chinese Office Action dated Feb. 28, 2015 in Application No. 201280052589.9, 16 pages.

(Continued)

*Primary Examiner* — Jimmy T Nguyen
(74) *Attorney, Agent, or Firm* — Shook, Hardy & Bacon, LLP

(57) ABSTRACT

A gripping mechanism for securing an end of a wire during tying with a wire tying system is provided. The gripping mechanism may secure a first end of a wire strap around a bale of recycled material during knotting of the wire strap. As such, the gripping mechanism includes a gripping lever having a contact region adjacent the first end of the wire strap. In embodiments, the contact region includes at least one surface feature configured to secure the first end of the wire based on pivoting of the gripping lever. In further embodiments, the contact region of the gripping lever disengages the wire based on rotation of the gripping lever in a first direction. Further, the contact region of the gripping lever may engage against the first end of the wire based on rotation of the griping lever in a second direction, during actuation of the gripping mechanism.

20 Claims, 7 Drawing Sheets

(56) References Cited

U.S. PATENT DOCUMENTS

| | | | | |
|---|---|---|---|---|
| 2,963,958 | A | | 12/1960 | Nelson et al. |
| 3,037,534 | A | | 6/1962 | Brouse |
| 3,037,535 | A | | 6/1962 | Linehan et al. |
| 3,086,450 | A | | 4/1963 | Tarbox |
| 3,099,204 | A | | 7/1963 | Stromberg |
| 3,232,216 | A | | 2/1966 | Enstad et al. |
| 3,251,296 | A | | 5/1966 | Smith |
| 3,295,436 | A | | 1/1967 | Dalton et al. |
| 3,327,618 | A | | 6/1967 | Cook |
| 3,338,273 | A | | 8/1967 | Kalning |
| 3,447,448 | A | | 6/1969 | Pasic |
| 3,880,204 | A | | 4/1975 | Sarff et al. |
| 3,888,134 | A | | 6/1975 | Miranda et al. |
| 3,889,584 | A | | 6/1975 | Wiklund-Bergeforsen et al. |
| 4,079,667 | A | | 3/1978 | Lems |
| 4,114,527 | A | | 9/1978 | O'Neill |
| 4,164,176 | A | * | 8/1979 | Brouse ..... B65B 13/06 100/26 |
| 4,177,842 | A | | 12/1979 | Dilley |
| 4,252,157 | A | | 2/1981 | Ohnishi |
| 4,302,991 | A | | 12/1981 | Brouse et al. |
| 4,403,542 | A | | 9/1983 | Lewis |
| 4,566,378 | A | | 1/1986 | Fleissner |
| 4,577,554 | A | | 3/1986 | Brouse |
| 4,587,791 | A | | 5/1986 | Brouse et al. |
| 4,611,534 | A | | 9/1986 | Kudlicka |
| 4,655,264 | A | | 4/1987 | Dilley |
| 4,730,434 | A | | 3/1988 | Knudsen |
| 4,739,700 | A | | 4/1988 | Brouse et al. |
| 4,817,519 | A | | 4/1989 | Brouse et al. |
| 4,827,991 | A | | 5/1989 | Jacobsen et al. |
| 5,078,057 | A | | 1/1992 | Pearson |
| 5,392,821 | A | * | 2/1995 | Chudy ..... B65B 13/305 140/93.2 |
| 5,433,255 | A | | 7/1995 | Wiedel |
| 5,467,804 | A | | 11/1995 | Kupferschmidt et al. |
| 5,494,081 | A | | 2/1996 | Wiedel |
| 5,577,760 | A | | 11/1996 | Pressler |
| 5,704,283 | A | | 1/1998 | Wiedel |
| 5,870,950 | A | | 2/1999 | Wiedel |
| 5,921,289 | A | | 7/1999 | Johnson |
| 6,009,646 | A | * | 1/2000 | Johnson ..... B21F 15/04 100/29 |
| 6,032,575 | A | | 3/2000 | Johnson |
| 6,283,017 | B1 | | 9/2001 | Johnson et al. |
| 6,363,843 | B1 | | 4/2002 | Daniel et al. |
| 6,571,691 | B1 | | 6/2003 | Jones |
| 6,640,700 | B2 | | 11/2003 | Helland et al. |
| 6,745,677 | B2 | | 6/2004 | Pearson et al. |
| 6,755,123 | B2 | | 6/2004 | Flaum et al. |
| 6,857,252 | B2 | | 2/2005 | Haberstroh |
| 6,920,741 | B2 | | 7/2005 | Devine |
| 6,923,113 | B2 | | 8/2005 | Bobren et al. |
| 6,957,835 | B2 | | 10/2005 | Rotole |
| 6,962,109 | B2 | | 11/2005 | Bobren et al. |
| 6,968,779 | B2 | | 11/2005 | Doyle et al. |
| 6,975,911 | B2 | | 12/2005 | Stamps et al. |
| 7,085,625 | B2 | | 8/2006 | Timothy et al. |
| 7,124,679 | B2 | | 10/2006 | Daniel et al. |
| 7,146,294 | B1 | | 12/2006 | Waitkus |
| 7,373,877 | B2 | | 5/2008 | Wiedel |
| 7,380,574 | B2 | | 6/2008 | Wiedel |
| 8,397,632 | B2 | | 3/2013 | Millett et al. |
| 8,757,055 | B2 | | 6/2014 | Millett et al. |
| 2003/0024404 | A1 | | 2/2003 | Daniel et al. |
| 2004/0144264 | A1 | | 7/2004 | Daniel et al. |
| 2006/0042477 | A1 | | 3/2006 | Daniel et al. |
| 2006/0042478 | A1 | | 3/2006 | Daniel et al. |
| 2009/0250930 | A1 | | 10/2009 | Eylenbosch et al. |
| 2013/0019764 | A1 | | 1/2013 | Yang |
| 2013/0180416 | A1 | | 7/2013 | Stein et al. |
| 2013/0247515 | A1 | | 9/2013 | Actis |

FOREIGN PATENT DOCUMENTS

| | | | |
|---|---|---|---|
| CN | 2527767 | Y | 12/2002 |
| GB | 325783 | A | 5/1930 |
| GB | 417803 | A | 10/1934 |
| GB | 420098 | A | 11/1934 |
| GB | 474813 | A | 11/1937 |
| GB | 704931 | A | 3/1954 |
| GB | 984251 | A | 2/1965 |

OTHER PUBLICATIONS

European Search Report dated Apr. 3, 2015 in Application No. 12827753.0, 5 pages.

International Search Report with Written Opinion dated May 12, 2011 in Application No. PCT/US2011/026856, 7 pages.

Brian Taylor, "Fit to be tied: the right wire-tying system conserves costs while keeping bales in ship-shape," Baler Focus, Recycling Today, Feb. 2003, 5 pages.

"Bundling Demand Met by ISB," Converter The International Technical Publication for the Paper, Board, Film and Foil Converter, Jul. 2003, vol. 40, Issue 7, p. 20, 2 pages.

Cranston Machinery Co., Inc., Oak Grove, Oregon, 1000 Series Wire Strapper, 25 pages (Excerpts from Manual). Sep. 1996.

Non-Final Office Action dated Aug. 2, 2011 in U.S. Appl. No. 12/717,616, 11 pages.

Final Office Action dated Dec. 28, 2011 in U.S. Appl. No. 12/717,616, 9 pages.

Non-Final Office Action dated Jun. 12, 2012 in U.S. Appl. No. 12/717,616, 6 pages.

International Search Report with Written Opinion dated Nov. 20, 2012 in Application No. PCT/US2012/052869, 6 pages.

Notice of Allowance dated Nov. 23, 2012 in U.S. Appl. No. 12/717,616, 9 pages.

Non-Final Office Action dated Aug. 1, 2013 in U.S. Appl. No. 13/220,798, 16 pages.

Non-Final Office Action dated Aug. 27, 2013 in U.S. Appl. No. 13/753,188, 6 pages.

Final Office Action dated Feb. 4, 2014 in U.S. Appl. No. 13/220,798, 16 pages.

Notice of Allowance dated Feb. 11, 2014 in U.S. Appl. No. 13/753,188, 8 pages.

Non-Final Office Action dated Jun. 20, 2014 in U.S. Appl. No. 13/220,798, 15 pages.

Non-Final Office Action dated Feb. 13, 2015 in U.S. Appl. No. 14/263,483, 8 pages.

International Search Report with Written Opinion dated Jan. 27, 2015 in Application No. PCT/US2014/053986, 11 pages.

Notice of Allowance dated Feb. 2, 2015 in U.S. Appl. No. 13/220,798, 8 pages.

Notice of Allowance dated Mar. 11, 2015 in U.S. Appl. No. 14/263,483, 8 pages.

International Search Report with Written Opinion dated May 22, 2015 in Application No. PCT/US2015/015382, 11 pages.

"Samuel Strappiing Systems. The Science of Strap Selection. Handbook [online]. Oct. 2, 2012 [retrieved on May 20, 2015]. Retrieved from the Internet<URLhttp://www. thomasnet.com/white-papers/abstract/1 01792/the-science-of-strap-selection. html>".

International Search Report with Written Opinion dated Jun. 4, 2015 in Application No. PCT/US2015/019446, 11 pages.

Non-Final Office Action Dated Sep. 10, 2015 in U.S. Appl. No. 14/185,524, 10 pages.

Notice of Allowance dated Nov. 13, 2015 in U.S. Appl. No. 14/185,524, 8 pages.

* cited by examiner

GRIPPING MECHANISM

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Embodiments of the present invention relate to a gripping mechanism on a strapping machine. More particularly, embodiments of the present invention relate to a gripping mechanism coupled to a wire tying system of a strapping machine for securing at least one end of a wire tie applied to a baled material.

BACKGROUND OF THE INVENTION

Traditional bulk-material baling machines incorporate a tying system for wrapping and/or securing the baled material, such as a wire tying system. In forming bales of compressible materials, it is important to surround the baled material with a wire having sufficient strength to maintain the form of the compressed bale for shipping and/or storage. At the same time, the wire used to secure a bale must be adequately tensioned by the tying system, as well as securely knotted and/or tied around the bale. In some instances, a wire tying system requires one or more features to securely position at least one end of a wire during knotting/tying, which enables tensioning of the wire and tightening of the strap around the bale. However, traditional hydraulic gripping mechanisms may cause mechanical complications during tensioning of the wire, as well as add to the expense of the overall wire tying system.

Accordingly, embodiments of the present invention introduce technology for resolving the above-mentioned issues conventionally experienced when securing a wire strap applied with a bulk-material baling system.

In one embodiment of the invention, a gripping lever of a gripping mechanism is provided for securing at least one end of a wire. The gripping lever includes a first end; a second end opposite the first end; and a contact region configured to couple to the at least one end of a wire. In embodiments, the gripping lever is coupled to the gripping mechanism at a pivot joint. Additionally, the gripping lever is configured to rotate about the pivot joint during actuation of the gripping lever.

In another illustrative aspect, a wire tying system includes a knotter assembly and a gripping mechanism coupled to the knotter assembly. The gripping mechanism includes a gripping lever, which further includes: 1) a first end of the gripping lever; 2) a second end of the gripping lever, said second end opposite the first end; and 3) a contact region of the gripping lever. In embodiments, at least a portion of the contact region is configured to contact a first end of a wire secured by the gripping mechanism.

According to a further illustrative aspect, embodiments of the invention are directed to a gripping mechanism for securing a wire during tying. The gripping mechanism includes a gripping lever coupled to the gripping mechanism at a pivot joint, the gripping lever configured to pivot about the pivot joint during actuation of the gripping lever. The gripping lever includes a contact region comprising an upper portion and a lower portion, wherein the lower portion comprises an outer surface, wherein at least a portion of the outer surface of the lower portion is configured to secure a first end of the wire.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

The present invention generally relates to a gripping mechanism on a strapping machine. More particularly, embodiments of the present invention relate to a gripping mechanism coupled to a wire tying system of a strapping machine, for securing at least one end of a wire tie applied to a baled material. In embodiments, the gripping mechanism is used to secure a wire strap around a bale of recycled material during knotting of the wire strap. As such, embodiments of the gripping mechanism are coupled to and/or adjacent to a wire tying system of a strapping machine for baling bulk material.

Accordingly, in one embodiment of the invention, a gripping lever of a gripping mechanism is provided for securing at least one end of a wire. The gripping lever includes a first end; a second end opposite the first end; and a contact region configured to couple to the at least one end of a wire. In embodiments, the gripping lever is coupled to the gripping mechanism at a pivot joint. Additionally, the gripping lever is configured to rotate about the pivot joint during actuation of the gripping lever.

In another illustrative aspect, a wire tying system includes a knotter assembly and a gripping mechanism coupled to the knotter assembly. The gripping mechanism includes a gripping lever, which further includes: 1) a first end of the gripping lever; 2) a second end of the gripping lever, said second end opposite the first end; and 3) a contact region of the gripping lever. In embodiments, at least a portion of the contact region is configured to contact a first end of a wire secured by the gripping mechanism.

According to a further illustrative aspect, embodiments of the invention are directed to a gripping mechanism for securing a wire during tying. The gripping mechanism includes a gripping lever coupled to the gripping mechanism at a pivot joint, the gripping lever configured to pivot about the pivot joint during actuation of the gripping lever. The gripping lever includes a contact region comprising an upper portion and a lower portion, wherein the lower portion comprises an outer surface, wherein at least a portion of the outer surface of the lower portion is configured to secure a first end of the wire.

Figure 1A:
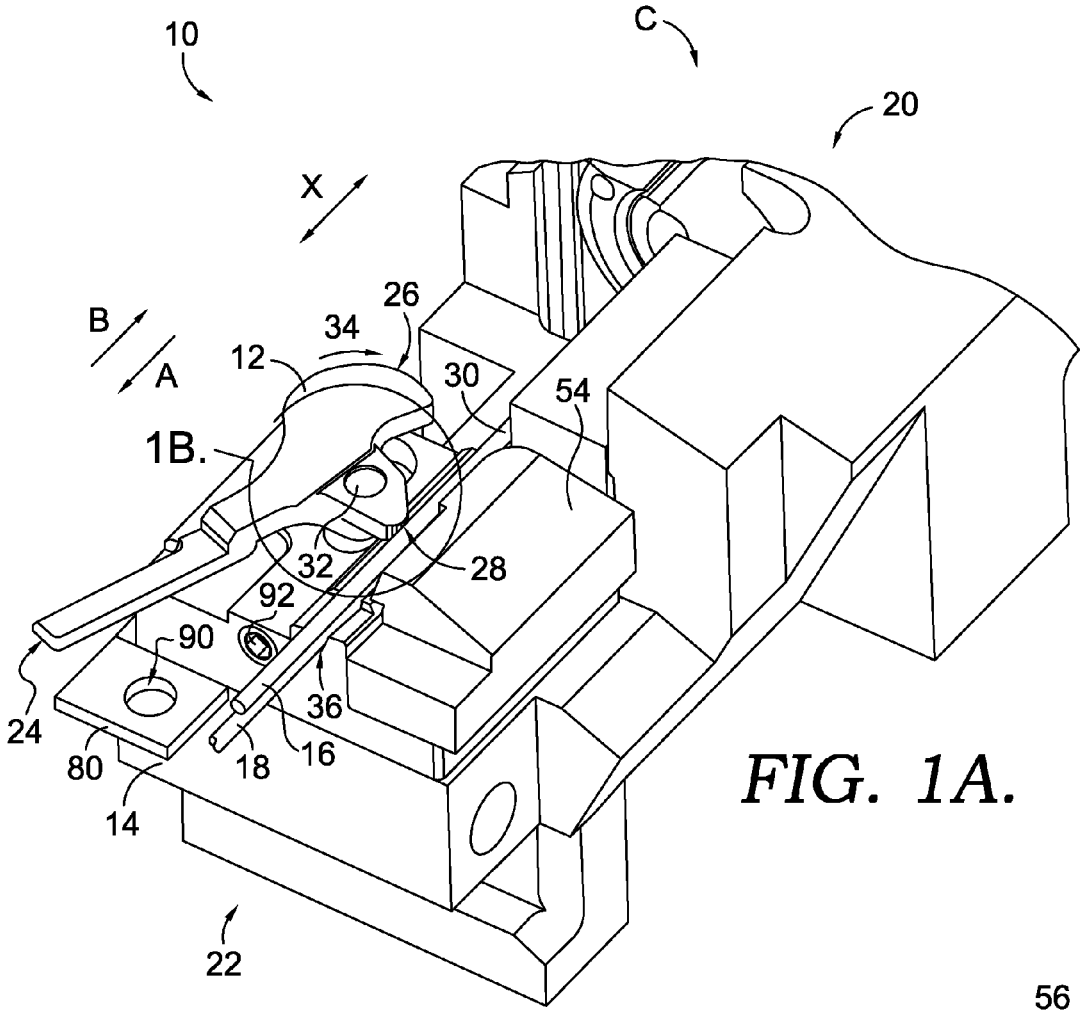
FIG. 1A is a bottom, perspective view of an exemplary gripping mechanism for bulk material baling, in accordance with an embodiment of the invention.

With reference now to the example of FIG. 1A, an embodiment of a gripping mechanism 10 is viewed from a bottom side C. Embodiments of the gripping mechanism 10 include a gripping lever 12 pivotably coupled to a base 14. In embodiments, the gripping lever 12 rotates about a pivot joint 32, and is configured to secure a first end 16 of a wire 30. In some embodiments, gripping lever 12 secures the first end 16 of wire 30 against at least a portion of the wire contact region 28 on the body of the gripping lever 12. In further embodiments, the wire contact region 28 of gripping lever 12 is configured to secure at least a portion of the first end 16 of a wire 30 against a tension support 54.

In some embodiments, the gripping mechanism 10 is actuated in response to tension applied from the second direction B to a second end 18 of the wire 30. As such, in some embodiments of the invention, the first end 16 of the wire 30 enters the gripping mechanism 10 from a first direction A at a first end 20 of the base 14, towards the second end 22 of the base 14. In some embodiments, in response to tension applied from the second direction B to the second end 18 of the wire 30, the gripping lever 12 becomes engaged against the first end 16 of the wire 30. In further embodiments, the gripping lever 12 may become engaged against the first end 16 of the wire 30 based on pivoting of the gripping lever 12 about the pivot joint 32. In one example, a portion of a wire tying system may activate the gripping lever 12, causing rotation of the gripping lever 12 and engaging the contact region 28 against the first end 16 of the wire 30. In one embodiment, a portion of a knotter assembly coupled to a wire tying system may engage against a portion of the gripping lever 12, causing rotation and actuation of the gripping lever 12 (i.e., engagement of the contact region 28 with the first end 16 of the wire 30 in response to triggering by the knotter assembly).

As further depicted in FIG. 1A, embodiments of the gripping lever 12 of the gripping mechanism 10 include a first end 24 opposite a second end 26, with a wire contact region 28 along the body of the gripping lever 12. In embodiments, the wire contact region 28 may be any portion of the gripping lever 12 configured to contact at least a portion of a wire 30. In one embodiment, as shown in the enlarged view 56 of FIG. 1B, embodiments of the wire contact region 28 include one or more surface features 64 configured to contact the wire 30 travelling between the gripping lever 12 and the tension support 54. In one embodiment, the one or more surface features 64 provide an altered surface of the contact region 28 that creates friction with the contacted portion of the wire 30. As such, in some embodiments, the surface features 64 may include one or more raised ridges, embossed shapes, bumps, lines, cross-hatch texture, and/or other surface treatment that extends from the surface of the contact region 28 and creates friction with the wire 30 to reduce and/or restrict travel of the wire 30. In further embodiments, the one or more surface features 64 may include one or more depressions, engravings, indentations, debossed shapes, imprinted texture, and/or other surface treatment that extends from the surface of the contact region 28.

In some embodiments, alternating rotation between the clockwise direction 34 and the counterclockwise direction 42 applies alternating amounts of tension against a surface of the wire 30, secured within wire cavity 36, and adjacent both the wire contact region 28 and the tension support 54. In one embodiment, wire cavity 36 includes both ends of a loop of wire, such as the first end 16 and second end 18 of the wire 30. In further embodiments, while wire cavity 36 encloses at least a portion of both first end 16 and second end 18 of a wire 30, gripping lever 12 may be configured to contact a portion of the first end 16 of the wire 30, while not contacting the second end 18.

In one embodiment of the invention, the gripping mechanism 10 includes a sensor mount 88 having a sensor 90 that detects at least a portion of the gripping lever 12. For example, the first end 24 may be configured to activate the sensor 90 based on movement of the gripping mechanism 10 with respect to the sensor 90. As shown in the example of FIG. 1A, in some embodiments, the gripping lever 12 is separated a threshold distance from the sensor 90, thereby not activating the sensor 90. As such, in one embodiment, a sensor 90 may be used to determine that the gripping lever 12 is in an open position and/or that a wire 30 is not being gripped by the gripping mechanism 10.

Figure 1B:
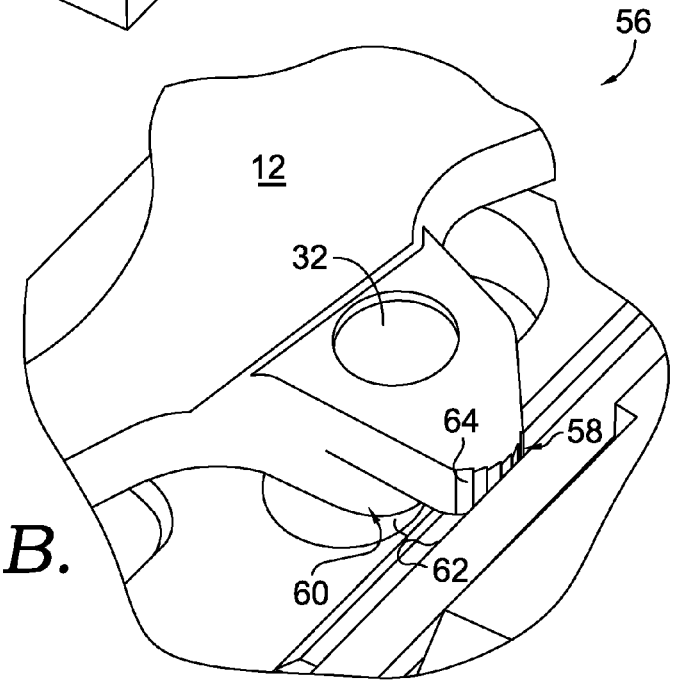
FIG. 1B is an enlarged, perspective view of the exemplary gripping mechanism of FIG. 1A, in accordance with an embodiment of the invention.

In further embodiments, as shown in FIG. 1B, the contact region 28 may include a lower portion 58 and an upper portion 60 (i.e., contact region 28 is viewed from a bottom side C, with the upper portion 60 on the bottom side C of the gripping lever 12). In embodiments, the lower portion 58 is adjacent the first end 16 of a wire 30, while the upper portion is adjacent the second end 18 of the wire 30. As shown in the perspective view of FIG. 1B, a lower portion 58 of the wire contact region 28 is configured to contact the first end 16 of a wire 30, while the upper portion 60 of the wire contact region 28 is recessed a threshold distance 62, allowing free travel of the second end 18.

Returning to FIG. 1A, in some embodiments, the gripping lever 12 may rotate around pivot joint 32 in a clockwise direction 34 upon insertion of at least a portion of a wire 30 in wire cavity 36 in a first direction A. In further embodiments, gripping lever 12 may reverse the direction of rotation for pivoting about pivot joint 32 in a counterclockwise direction during tensioning of the wire 30. For example, tension applied to the second end 18 of the wire 30, in the second direction B, may cause rotation of the gripping lever 12 about pivot joint 32 in a counterclockwise direction. As such, upon clockwise rotation of the gripping lever 12 (corresponding to travel of the first end 16 in the first direction A), the gripping lever 12 may be positioned in an "open" and/or unlocked position. In a further embodiment, the gripping lever 12 may be positioned in a "closed" and/or locked position upon counterclockwise rotation of the gripping lever 12 (corresponding to travel of the second end 18 in the second direction B, which in turn applies tension against the first end 16 in the same, second direction B).

Embodiments of the gripping mechanism 10 are configured for use with a knotter assembly of a wire tying system for tying a wire strap around a baled material, such as the knotter assembly described in one or more of the following U.S. patent applications: U.S. application Ser. No. 12/717,616, filed Mar. 4, 2010, entitled "Knotter Assembly,", now U.S. Pat. No. 8,397,632, issued Mar. 19, 2013; U.S. application Ser. No. 13/220,798, filed Aug. 30, 2011, entitled "Knotter Assembly,"; and U.S. application Ser. No. 13/753,188, filed Jan. 29, 2013, entitled "Method For Removing A Twist-Module Sub-Assembly In A Knotter Assembly,", the disclosure of each of which is hereby incorporated by reference in its entirety.

Additionally, the knotter assembly used with gripping mechanism 10 may include a control system coupled directly or indirectly to the knotter assembly. For example, a strapping machine of a wire tying system may include a common control system configured to control at least a portion of the wire tying mechanism and/or related components, such as the control system described in U.S. Application No. 61/873,662, filed Sep. 4, 2013, entitled "Control User Interface For Tying System,", the disclosure of which his hereby incorporated by reference in its entirety.

Figure 2A:
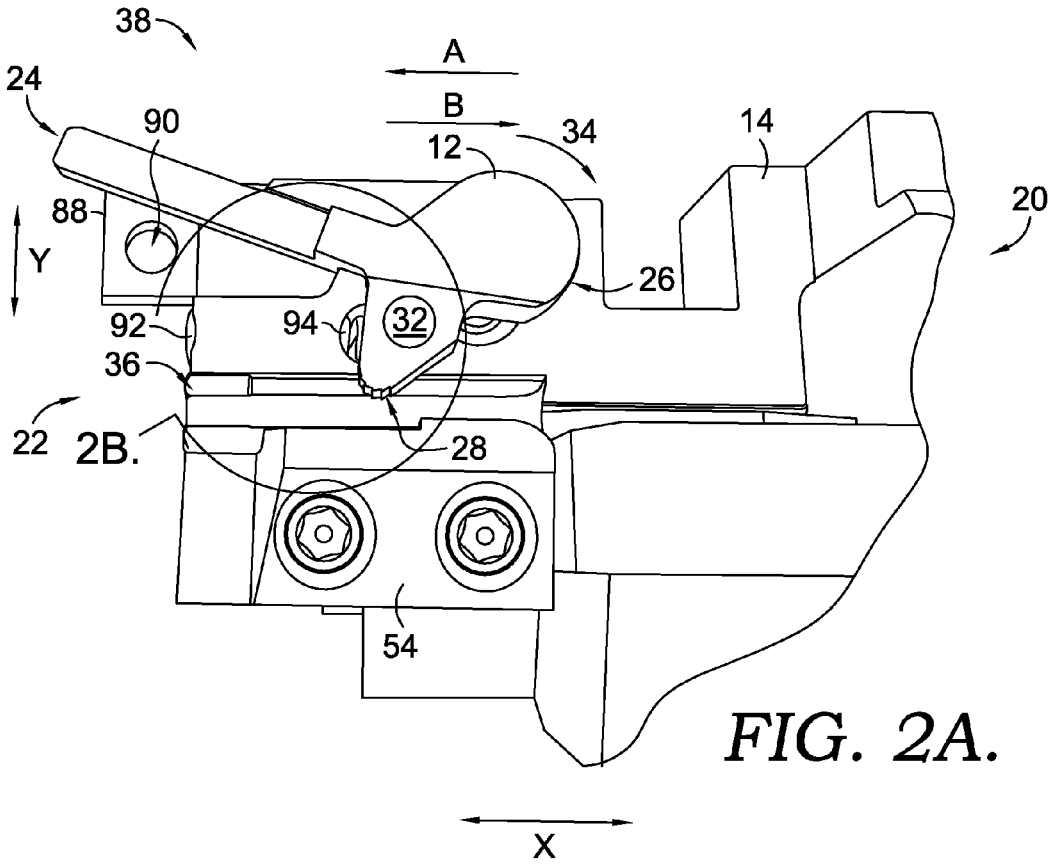
FIG. 2A is a bottom view of the exemplary gripping mechanism of FIG. 1A in a first position, in accordance with an embodiment of the invention.

Accordingly, as shown in the bottom view of the gripping mechanism 38 in FIG. 2A, rotation of the gripping lever 12 in a clockwise direction 34 (i.e., travel of the first end 24 along the y-axis) causes pivoting of the gripping lever 12 about the pivot joint 32, which increases an amount of space between the wire contact region 28 and the wire 30. In further embodiments, rotation of the gripping lever 12 in a clockwise direction causes pivoting of the gripping lever 12 about the pivot joint 32, which increases an amount of space between the contact region 28 and the tension support 54. As such, the first position of FIG. 2A (i.e., an "open" position) is configured to accept a first end 16 of a wire 30 traveling in a first direction A.

Figure 2B:
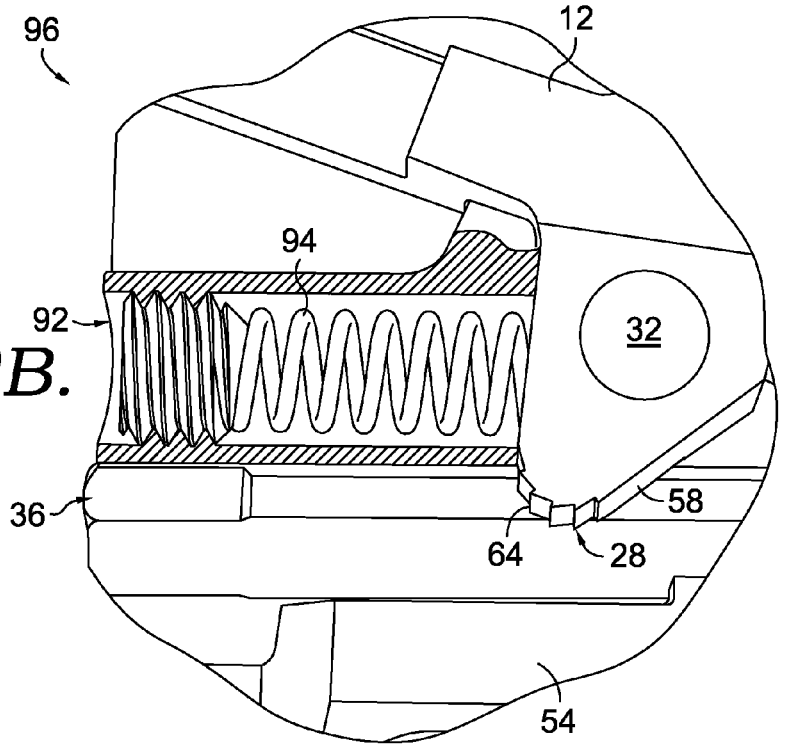
FIG. 2B is an enlarged, cut-away view of the exemplary gripping mechanism of FIG. 2A, in accordance with an embodiment of the invention.

As further depicted in the enlarged, cut-away view 96 of FIG. 2B, the gripping mechanism 38 may include a set screw 92 that engages a spring 94 with at least a portion of the gripping lever 12. As such, in some embodiments, the spring 94 may bias the gripping lever 12 into a particular position relative to the pivot joint 32.

Further, upon tensioning of the wire 30 in a second direction B, the gripping lever 12 rotates in a counterclockwise direction 42 to reduce an amount of space between the contact region 28 and the tension support 54. In further embodiments, rotation of the gripping lever 12 in a counterclockwise direction 42 orients the wire contact region 28 closer to the tension support 54, as shown in the exemplary second position of gripping mechanism 40 in FIG. 3 (i.e., the "closed" position). Accordingly, in some embodiments of the invention, one or more surface features 64 on the contact region 28 of the gripping lever 12 may come into contact with the wire 30 upon rotation of the gripping lever 12 into the closed position. In embodiments, contact of one or more of the surface features 64 of the contact region 28 with at least a portion of the wire 30 restricts travel of the first end 16 in the second direction B, while the second end 18 is tensioned in the second direction B. In one embodiment, the first end 16 of the wire 30 is inserted into the gripping mechanism 10 in the first direction A, and is restricted from being withdrawn from the gripping mechanism 10 in the second direction B based on friction between the wire 30 and at least a portion of the gripping lever 12.

Figure 3:
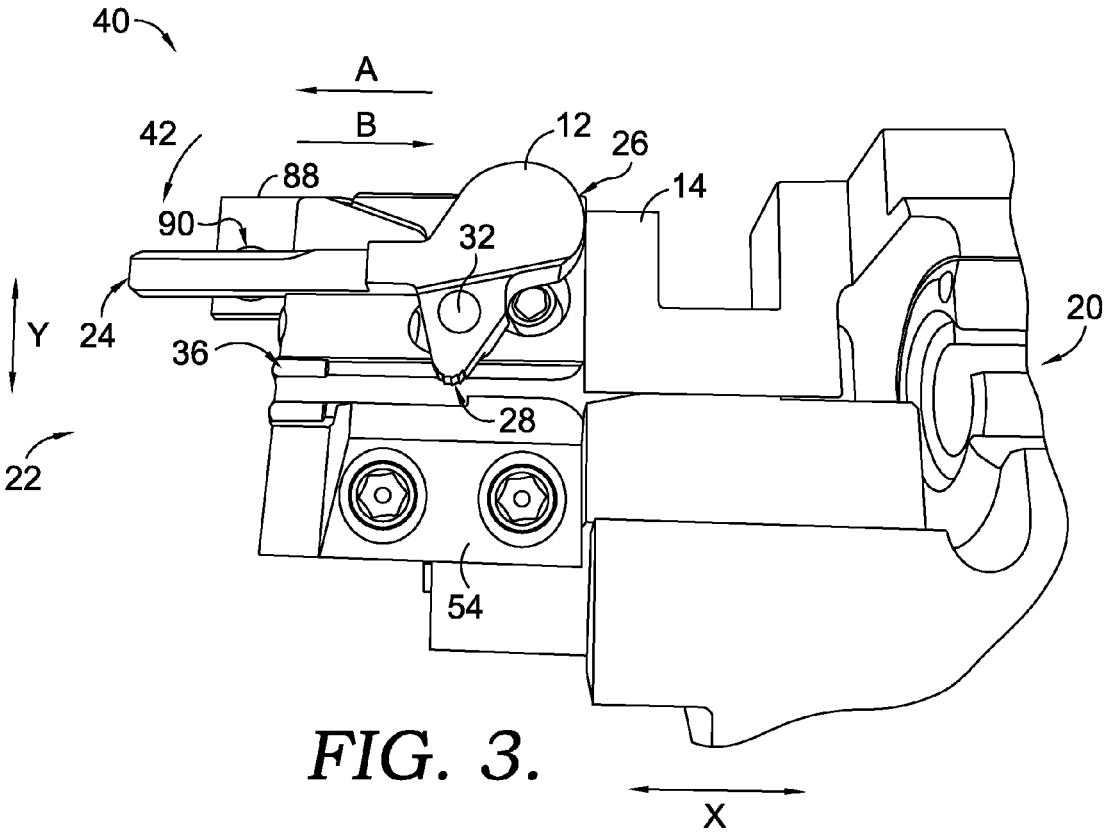
FIG. 3 is a bottom view of the exemplary gripping mechanism of FIG. 1A in a second position, in accordance with an embodiment of the invention.

In one embodiment, the gripping mechanism 40 includes a sensor mount 88 having a sensor 90 that detects at least a portion of the gripping lever 12. For example, the first end 24 may be configured to activate the sensor 90 based on movement of the gripping mechanism 40 with respect to the sensor 90. As shown in the example of FIG. 3, in some embodiments, the gripping lever 12 is shifted into a position along the y-axis that is detectable by the sensor 90, thereby activating the sensor 90. As such, in one embodiment, a sensor 90 may be used to determine that the gripping lever 12 is in a closed position and/or that a wire 30 is being gripped by the gripping mechanism 40.

Figure 4:
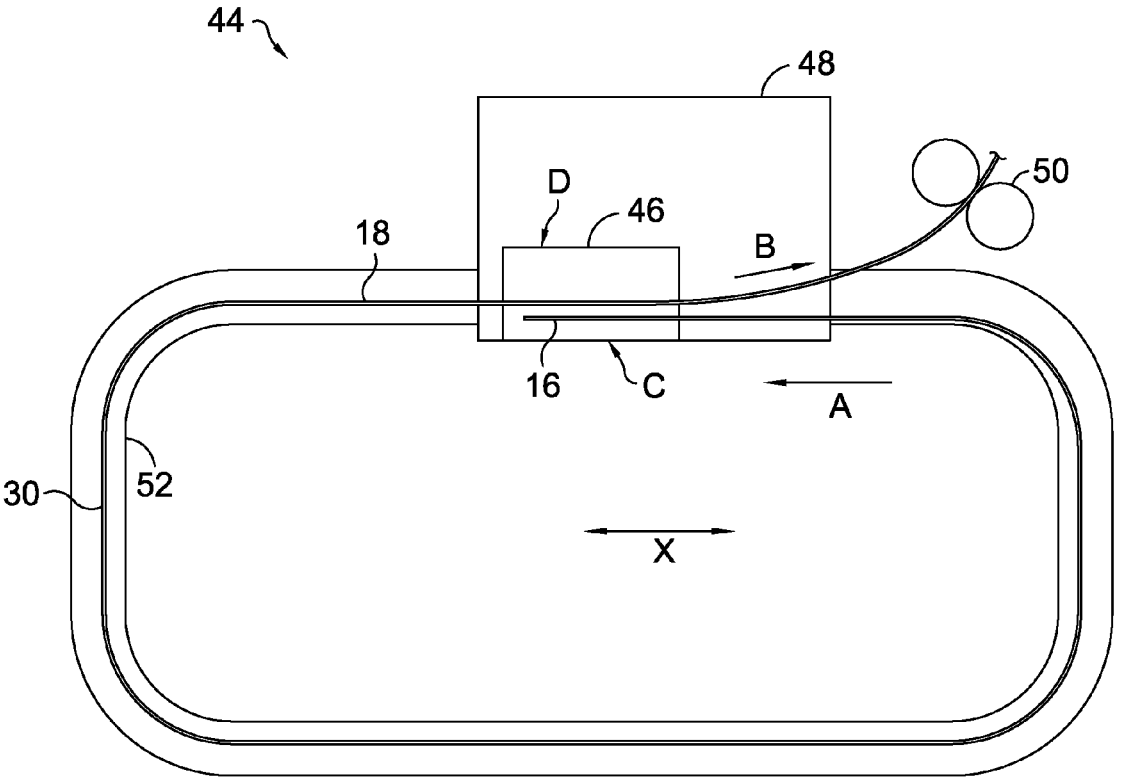
FIG. 4 is a schematic, side view of an exemplary strapping machine having a gripping mechanism and a wire tying system, in accordance with an embodiment of the invention.

As shown in the exemplary side view of FIG. 4, a loop of wire 30 is formed around a baling apparatus 44, which includes a gripping mechanism 46 coupled to a wire tying assembly 48 (e.g., a knotter assembly), and a tensioning mechanism 50. In embodiments, tension mechanism 50 may include any number of features for use during tensioning of a wire with a wire tying system, and is shown in the example of FIG. 4 with adjacent feed wheels for illustrative purposes only. When viewed from the side, the bottom side C of the gripping mechanism 46 is facing downward, while the top side D of the gripping mechanism 46 is oriented in the opposite direction. In embodiments, during loading of the baling apparatus 44 with wire 30, the first end 16 of the wire 30 enters the track 52 of the baling apparatus 44 in the first direction A, travels around a perimeter of the track 52, and returns through the wire tying assembly 48 to the gripping mechanism 46. As such, when viewed from the bottom side C of the gripping mechanism 46 (i.e., the bottom view of FIG. 1A), the wire 30 is retained and/or layered within the gripping mechanism 46 such that the first end 16 is closest the bottom side C, and the second end 18 is closest the top side D. Accordingly, the gripping mechanism 46 is configured to secure the first end 16 of the wire 30 during application of tension by the tensioning mechanism 50. In embodiments, in response to tension applied by the tensioning mechanism 50 in the second direction B, travel of the first end 16 of the wire 30 is restricted (in the second direction B) by the gripping mechanism 46. In particular, in some embodiments, the gripping lever 12 of the gripping mechanism 46 secures at least a portion of the first end 16 of the wire 30 during tensioning and/or knotting of the wire 30.

Figure 5:
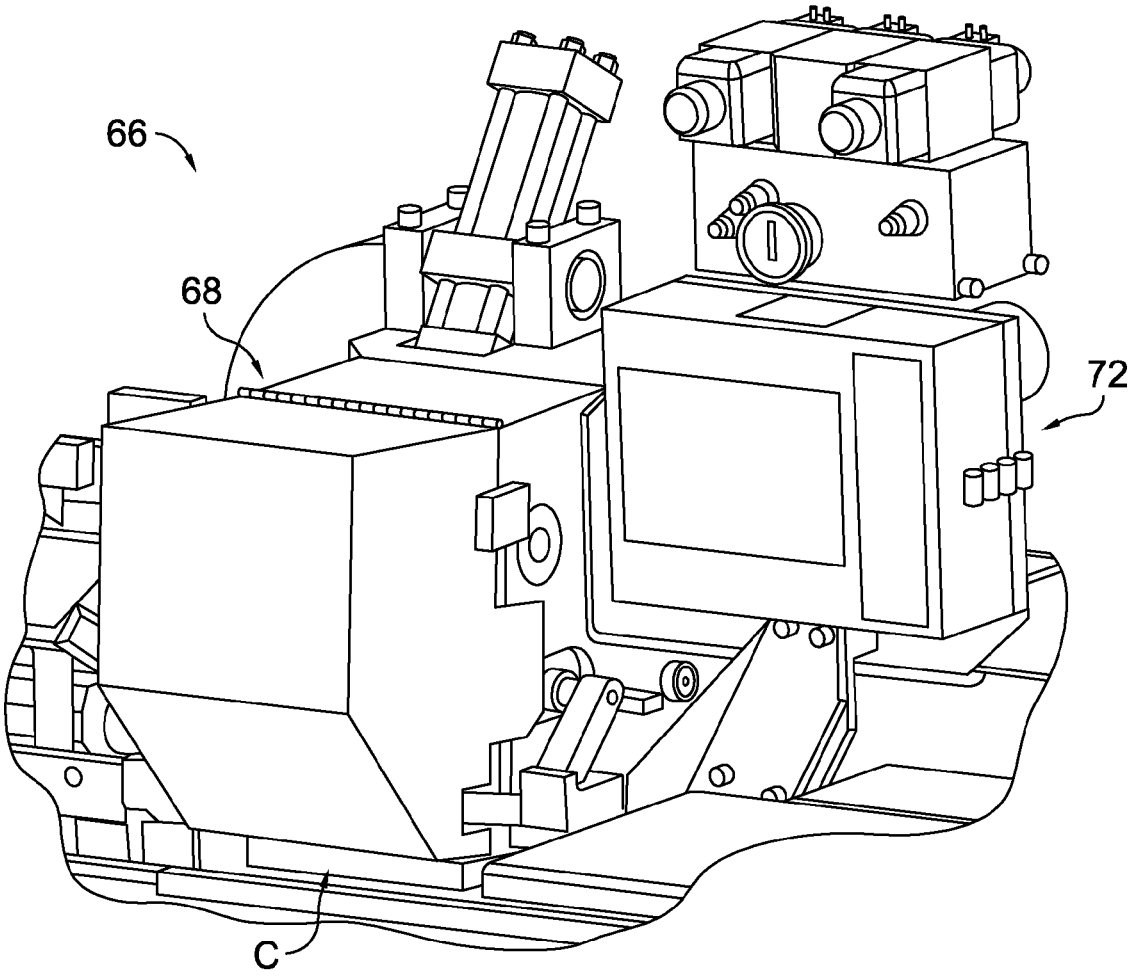
FIG. 5 is a perspective view of an exemplary wire tying system, in accordance with an embodiment of the invention.

In response to tying and/or knotting of the wire 30 by the wire tying assembly 48, at least a portion of the wire 30 secured by the gripping mechanism 46 may be released by the gripping mechanism 46 and/or wire tying assembly 48. In embodiments, the gripping mechanism 46 may be in contact with a wire tying assembly 48, such as a removable CORE™ component including one or more wear parts of a knotter assembly. In further embodiments, the gripping mechanism 46, in contact with the removable CORE™ component, may be activated in response to one or more parts of the knotter assembly, such as by contact with at least a portion of the knotter cover of the wire tying system. As shown in the embodiment of FIG. 5, an embodiment of a wire tying system 66 may include a wire tying assembly 68 coupled to a control mechanism 72. In embodiments, the control mechanism 72 is configured to control one or more components of the wire tying system 66.

Figure 6:
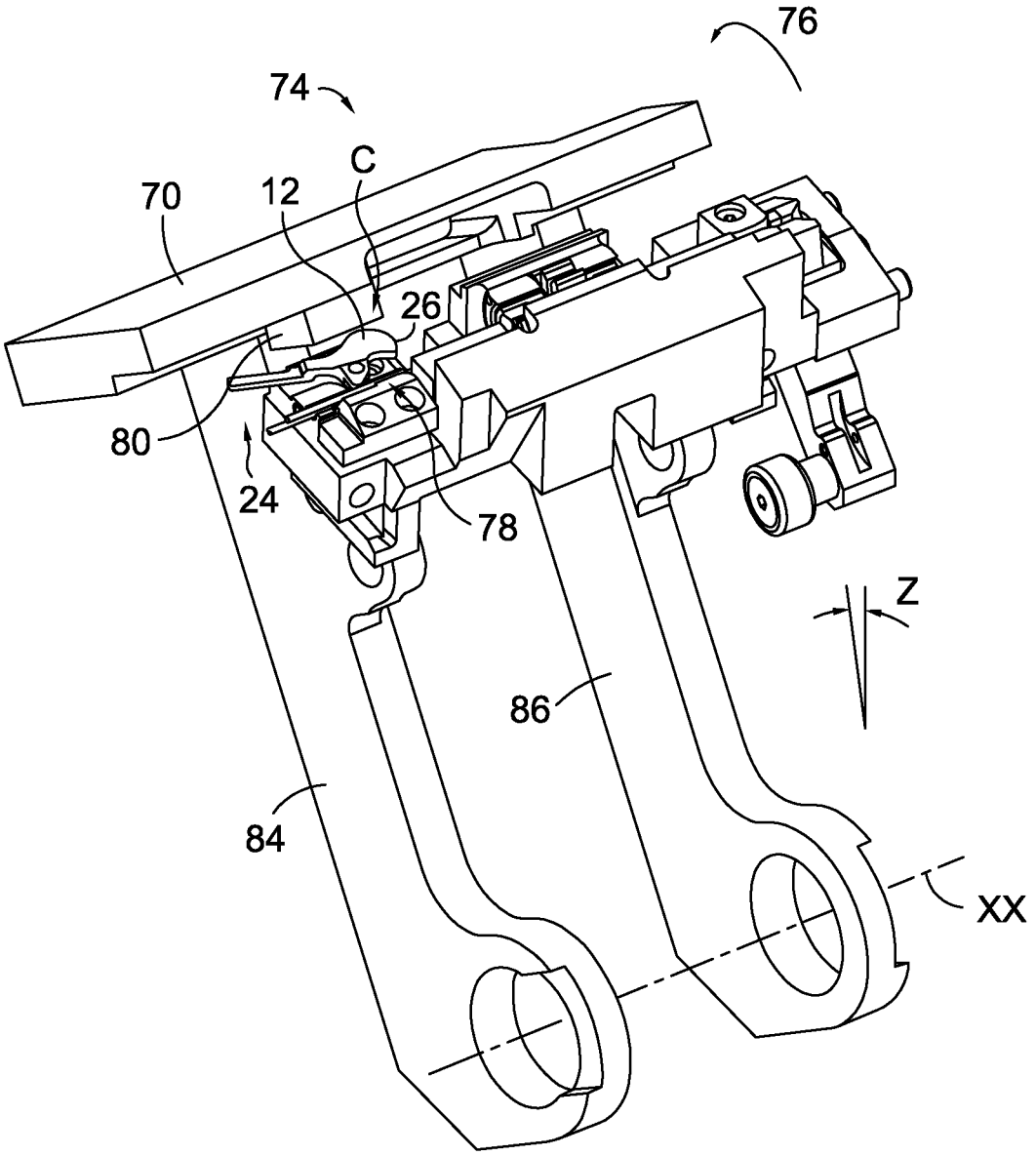
FIG. 6 is a bottom, perspective view of a cover of the wire tying system of FIG. 5 and a gripping mechanism, in accordance with an embodiment of the invention.

Accordingly, as shown in FIG. 6, the exemplary wire tying system 74 includes a knotter cover 70 configured to rotate in a direction of travel 76 at an angle Z with respect to the vertical orientation of the wire tying system 74. In one embodiment, the angle Z is a threshold angle of movement of the wire tying system 74. In a further embodiment, angle Z is based on a threshold distance of travel of the knotter cover 70 about a rotation axis XX of the knotter cover 70. Further, in some embodiments, a gripping mechanism 78, having a gripping lever 12 with a first end 24 (opposite a second end 26), is configured to move from an unlocked to a locked position based on orientation of the gripping lever 12 with respect to the knotter cover 70. As shown in the example of FIG. 6, embodiments of the knotter cover 70 include a first knotter arm 84 and a second knotter arm 86 coupled to the knotter cover 70. In embodiments, with the knotter cover 70 rotated at angle Z, a wire guide 80 of the knotter cover 70 is disengaged (e.g., separated a threshold distance) from the gripping lever 12, thereby releasing tension applied to the gripping lever 12 and allowing the gripping mechanism 78 to release a wire. In embodiments, releasing the knotter cover 70 at an angle Z disengages the gripping mechanism 78 into an open position based on releasing the first end 24 of the gripping lever 12. In embodiments, the wire guide 80 of the knotter cover 70 may be any portion of a wire tying system 74 configured to engage or disengage at least a portion of the gripping mechanism 78. In one embodiment, the wire guide 80 of the knotter cover 70 is configured to engage or disengage one or more locking features of a gripping mechanism 78, such as the gripping lever 12 of the gripping mechanism 78. In another embodiment, the wire guide 80 of the knotter cover 70 is configured to contact at least a portion of the first end 24 of the gripping lever 12 during locking and unlocking of the gripping mechanism 78. In further embodiments, the knotter cover 70 is a knotter assembly cover, oriented in a partially-opened position, as shown in the example of FIG. 6.

Figure 7:
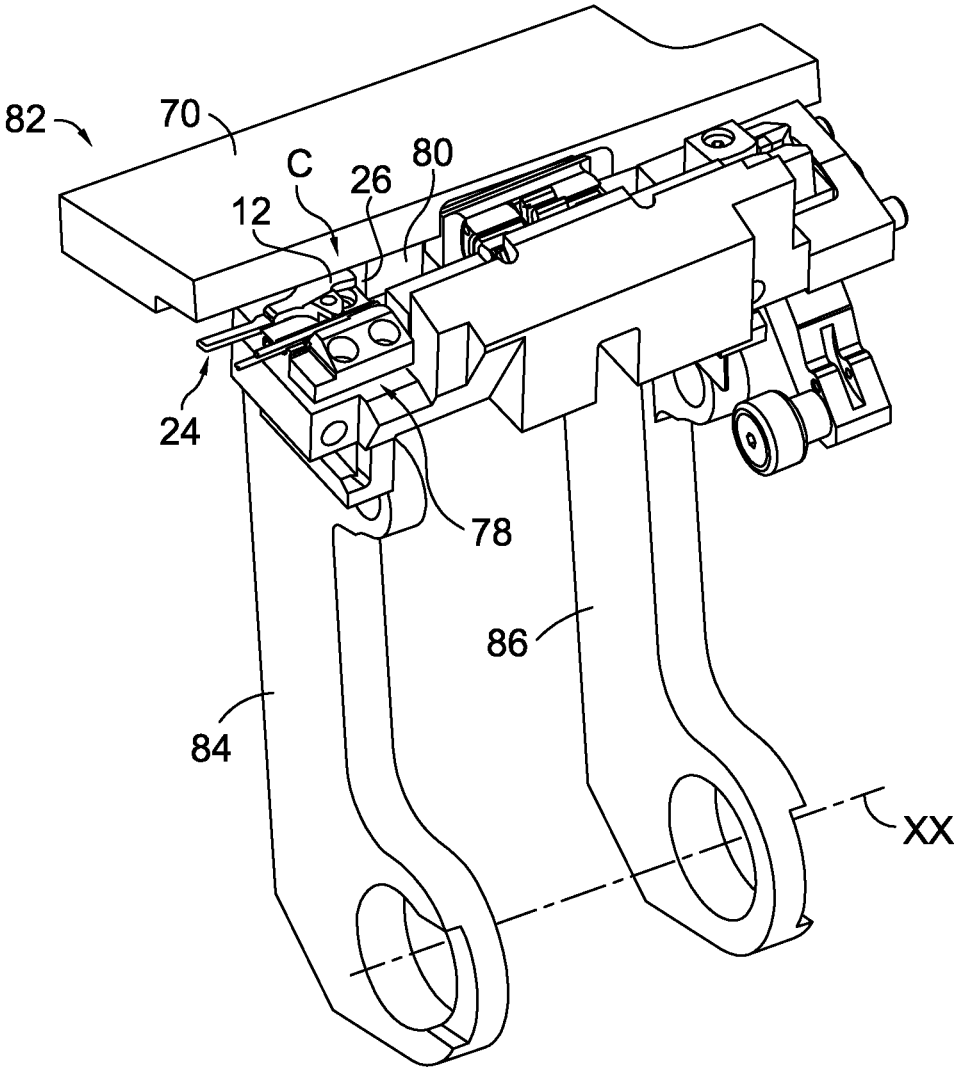
FIG. 7 is a bottom, perspective view of a cover of the wire tying system of FIG. 5 and a gripping mechanism, in accordance with an embodiment of the invention.

Accordingly, with reference to the exemplary wire tying system 82 of FIG. 7, the knotter cover 70 may be configured to rotate into a vertical position. In some embodiments, the gripping lever 12 of the gripping mechanism 78 is moved into a locked position, with the wire guide 80 of the knotter cover 70 applying a threshold amount of force against the first end 24 of the gripping lever 12, allowing the gripping mechanism 78 to secure a first end 16 of a wire 30. In embodiments, a threshold amount of travel of the knotter cover 70 is required to trigger, activate, engage, and/or release the gripping lever 12 of the gripping mechanism 78. As such, a threshold amount of force may be applied by the wire guide 80 of the knotter cover 70 corresponding to travel of the knotter cover 70. In one embodiment, during tying by the wire tying system 82, the gripping mechanism 78 may be in a closed position, such as the exemplary wire tying system 82 of FIG. 7. As such, the gripping mechanism 78 may be triggered by at least a portion of the wire tying system 82 during knotting and/or tying of the wire 30, such as by contact of the wire guide 80 with at least a portion of the griping lever 12 (e.g., the first end 24). In further embodiments, upon completion of tying by the wire tying system 82, the gripping mechanism 78 may be returned to an open position, such as the exemplary, open wire tying system 74 of FIG. 6.

In some embodiments, one or more components of a knotter assembly may be used to adjoin at least a portion of the gripping lever 12, causing rotation and/or pivoting about the pivot joint 32. In embodiments, based on orientation of the gripping lever 12 and corresponding contact of at least a portion of the wire contact region 28 with at least a portion of the wire 30, the first end 16 of the wire 30 may be restricted from travel within the wire cavity 36 during tensioning and/or knotting of the wire 30.

Figure 8A:
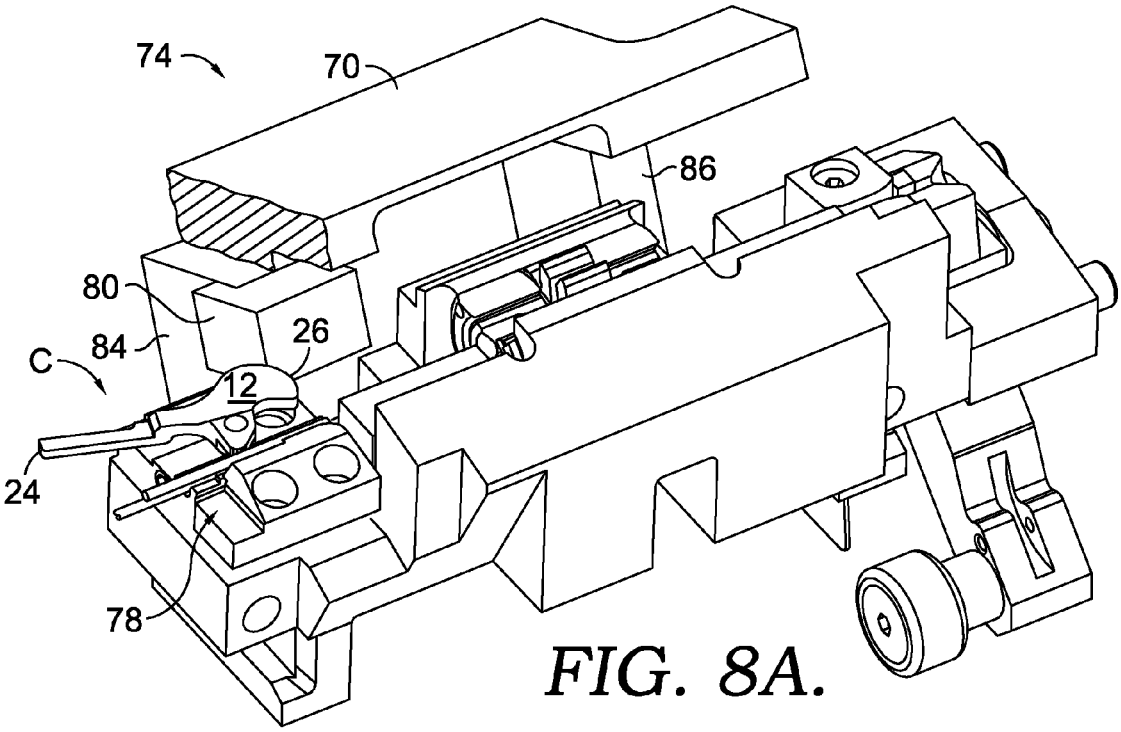
FIG. 8A an enlarged, bottom, perspective view of the gripping mechanism and wire tying system of FIG. 6, in accordance with an embodiment of the invention.

With reference to FIG. 8A, an enlarged, bottom, perspective view 74 of the gripping mechanism 78 (and portion of a wire tying system) of FIG. 6 is depicted according to an embodiment of the invention. As shown in FIG. 8A, in one embodiment, a wire guide 80 of the knotter cover 70 is configured to contact at least a portion of the gripping lever 12. In a further embodiment, the wire guide 80 is configured to contact the second end 26 of the gripping lever 12 during actuation of the gripping mechanism 78. As such, in the exemplary embodiment of FIG. 8A, with the gripping mechanism 78 in an open position, the wire guide 80 is not in contact with the gripping lever 12. In embodiments, contact between at least a portion of the gripping lever 12 and at least a portion of the wire guide 80 is based on a position of the knotter cover 70. As such, in one embodiment, an open position of the knotter cover 70 corresponds to an open position of the gripping mechanism 78, as the second end 26 of the gripping lever 12 is not in contact with the wire guide 80.

Figure 8B:
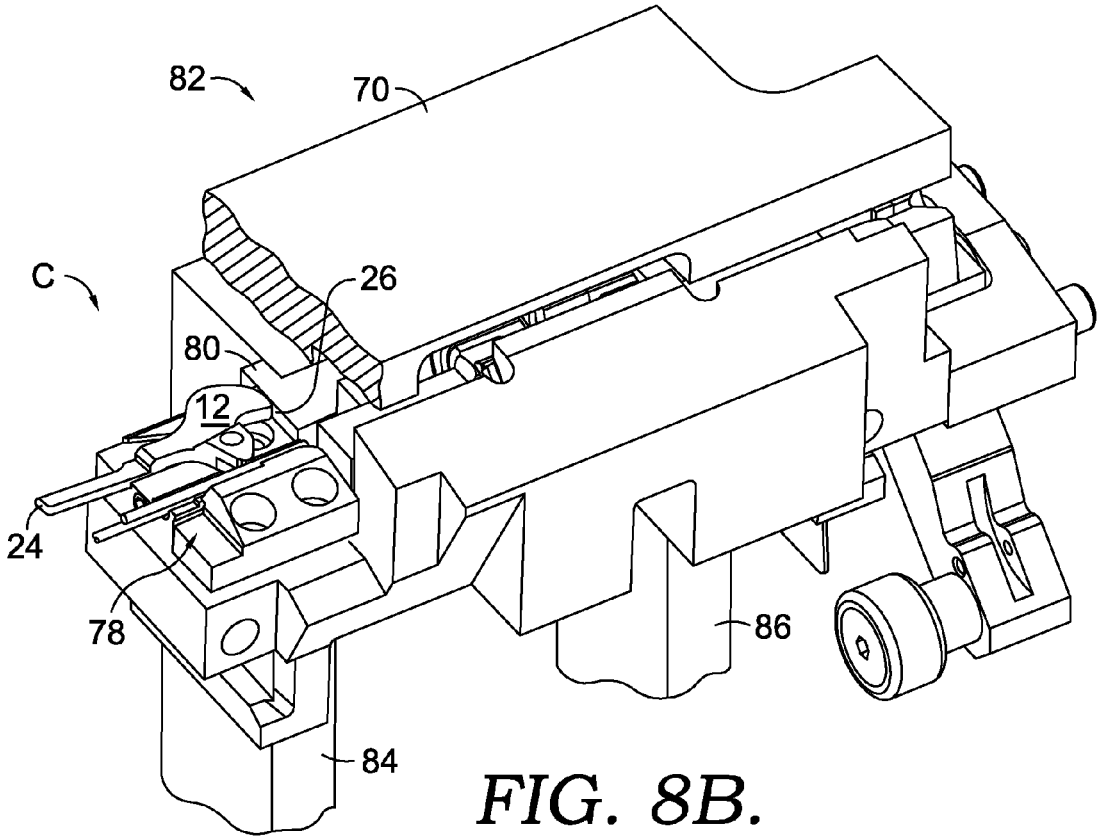
FIG. 8B is an enlarged, bottom, perspective view of the gripping mechanism and wire tying system of FIG. 7, in accordance with an embodiment of the invention.

In FIG. 8B, the enlarged, bottom, perspective view 82 of the gripping mechanism (and portion of a wire tying system) of FIG. 7 is depicted according to an embodiment of the invention. As shown in FIG. 8B, the wire guide 80 contacts the second end 26 of the gripping lever 12. In one embodiment, contact of the second end 26 of the gripping lever 12 with the wire guide 80 on the knotter cover 70 rotates the gripping lever 12 counterclockwise about the pivot joint 32, engaging the gripping mechanism 78 in a closed position. As such, in one embodiment, a closed position of the knotter cover 70 corresponds to a closed position of the gripping mechanism 78, as the second end 26 of the gripping lever 12 is in contact with the wire guide 80.

In embodiments, the gripping lever 12 may be biased into contact with the wire guide 80 based at least in part on engagement of the gripping lever 12 with the spring 94. In some embodiments, the spring 94 is configured to bias the gripping lever 12 into contact with the wire guide 80 such that contact of the wire guide 80 with the second end 26 of the gripping lever 12 causes the gripping lever 12 to engage in a closed position, such as the exemplary closed position of FIGS. 7 and 8B. In embodiments, spring 94 is configured to secure at least a portion of the gripping lever 12 against the wire guide 80, pivoting the gripping lever 12 into a closed position. In further embodiments, upon pivoting the gripping lever 12 into a closed position (based on the closed knotter cover 70 causing the wire guide 80 to contact the second end 26 of the gripping lever 12), the sensor 90 may detect that wire 30 is present in the gripping mechanism 78 based on the corresponding position of the first end 24 of the gripping lever 12 with respect to the sensor 90.

In further embodiments, when a wire 30 is present in the gripping mechanism 78, a knotter cover 70 is in a closed position, a second end 26 of the gripping lever 12 is in contact with at least a portion of the wire guide 80, and a first end 24 of the gripping lever 12 is activating the sensor 90, a wire tying system may be configured to knot and/or tie the wire 30. In some embodiments, a closed knotter cover 70 and a biased and/or engaged spring 94 prevents the gripping mechanism 78 from disengaging the wire 30 secured within the wire channel 36. As such, in some embodiments, tension applied to the second end 18 of the wire 30 may increase an amount of tension applied to the wire 30 based on the first end 16 of the wire 30 being secured by the gripping mechanism 78 in a closed position, as secured by the closed knotter cover 70 and corresponding closed gripping lever 12. As such, in some embodiments, a closed knotter cover 70 prevents the wire 30 from being released by the gripping mechanism 78. In further embodiments, an open knotter cover 70 prevents the wire 30 from being gripped by the gripping mechanism 78.

In further embodiments, upon opening the knotter cover 70, and disengaging the wire guide 80 from the second end 26 of the gripping lever 12, the wire 30 may be released by the griping mechanism 78. In one embodiment of the invention, upon opening the knotter cover 70 and disengaging the wire guide 80 from the second end 26 of the gripping lever 26, the gripping lever 12 is disengaged from the wire 30.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A gripping lever of a gripping mechanism for securing at least one end of a wire, the gripping lever comprising:

a first end;

a second end opposite the first end; and a contact region configured to couple to the at least one end of a wire, wherein the gripping lever is coupled to the gripping mechanism at a pivot joint, and further wherein the gripping lever is configured to rotate about the pivot joint during actuation of the gripping lever, wherein the first end of the gripping lever is configured to contact a knotter cover during actuation of the gripping lever;

wherein the knotter cover is configured to be in contact with the gripping lever beneath the gripping mechanism.

2. The gripping lever of claim 1, wherein the contact region comprises one or more surface features configured to engage at least a portion of the at least one end of a wire.

3. The gripping lever of claim 1, wherein the contact region is configured to pivot away from the at least one end of the wire when the gripping mechanism is in a first position.

4. The gripping lever of claim 3, wherein the first position comprises rotation of the gripping lever in a clockwise direction about the pivot joint.

5. The gripping mechanism of claim 1, wherein the contact region is configured to pivot into contact with the at least one end of the wire when the gripping mechanism is in a second position.

6. The gripping mechanism of claim 5, wherein the second position comprises rotation of the gripping lever in a counterclockwise direction about the pivot joint.

7. A wire tying system comprising:

a knotter cover; and a gripping mechanism comprising a gripping lever, wherein the gripping lever comprises:

1) a first end of the gripping lever;

2) a second end of the gripping lever, said second end opposite the first end; and 3) a contact region of the gripping lever, wherein at least a portion of the contact region is configured to contact a first end of a wire secured by the gripping mechanism, wherein the knotter cover is configured to be beneath the gripping mechanism when the contact region is in contact with the first end of a wire.

8. The wire tying system of claim 7, wherein the gripping lever is configured to pivot from a first position to a second position based on movement of the knotter cover from a first position to a second position.

9. The wire tying system of claim 8, wherein the gripping lever is configured to release the first end of the wire secured by the gripping mechanism when the knotter cover is in a first position and the gripping lever is in a first position.

10. The wire tying system of claim 9, wherein the knotter cover is in a first position relative to the knotter assembly based on pivoting of the knotter cover at a particular angle with respect to the knotter assembly.

11. The wire tying system of claim 8, wherein the gripping lever is configured to restrict movement of the first end of the wire secured by the gripping mechanism when the knotter cover is in a second position and the gripping lever is in a second position.

12. The wire tying system of claim 11, wherein the knotter cover comprises a contact region for contacting the first end of the gripping lever.

13. The wire tying system of claim 8, wherein the contact region comprises a lower portion adjacent the first end of the wire, wherein the lower portion comprises at least one surface feature.

14. The wire tying system of claim 13, wherein the contact region further comprises an upper portion adjacent a second end of the wire.

15. A gripping mechanism for securing a wire during tying, the gripping mechanism comprising:

a gripping lever having a first end and coupled to the gripping mechanism at a pivot joint, the gripping lever configured to pivot about the pivot joint during actuation of the gripping lever, wherein the gripping lever comprises:

a contact region comprising an upper portion and a lower portion, wherein the lower portion comprises an outer surface, wherein at least a portion of the outer surface of the lower portion is configured to secure a first end of the wire, wherein the first end of the gripping lever is configured to move from a first position to a second position based on the first end of the gripping lever contacting a knotter cover, wherein the knotter cover is configured to be beneath the gripping mechanism when the gripping lever is in the second position.

16. The gripping mechanism of claim 15, wherein the contact region further comprises an upper portion, wherein the upper portion is recessed a threshold distance from the outer surface of the lower portion.

17. The gripping mechanism of claim 15, wherein the first end is separated a threshold distance from the pivot joint, wherein pivoting of the gripping lever about the pivot joint comprises movement of the first end of the gripping lever from a first position to a second position.

18. The gripping mechanism of claim 17, wherein the first end of the gripping lever is adjacent the knotter cover, wherein the gripping lever is in a first position when the knotter cover is in an open position, and further wherein the gripping lever is in a second position when the knotter cover is in a closed position.

19. The gripping mechanism of claim 1, wherein a first portion of the knotter cover is positioned above the gripping mechanism when a second portion of the knotter cover is in contact with the gripping lever beneath the gripping mechanism.

20. The gripping mechanism of claim 1, wherein the contact region secures the at least one end of a wire against a tension support.

* * * * *